US010155241B2

(12) United States Patent
Harris et al.

(10) Patent No.: US 10,155,241 B2
(45) Date of Patent: Dec. 18, 2018

(54) LIQUID DISPENSER HAVING INDIVIDUALIZED PROCESS AIR CONTROL

(71) Applicant: Nordson Corporation, West Lake, OH (US)

(72) Inventors: Michael W. Harris, Eau Claire, WI (US); Rick J. Klaus, Alpharetta, GA (US)

(73) Assignee: Nordson Corporation, Westlake, OH (US)

( * ) Notice: Subject to any disclaimer, the term of this patent is extended or adjusted under 35 U.S.C. 154(b) by 180 days.

(21) Appl. No.: 14/719,615

(22) Filed: May 22, 2015

(65) Prior Publication Data

US 2015/0258567 A1 Sep. 17, 2015

Related U.S. Application Data

(62) Division of application No. 10/836,765, filed on Apr. 30, 2004.

(51) Int. Cl.

| | |
|---|---|
| ***B05C 5/02*** | (2006.01) |
| ***B05B 7/24*** | (2006.01) |
| ***B05C 5/00*** | (2006.01) |
| ***F17D 1/00*** | (2006.01) |
| *B05B 7/08* | (2006.01) |

(52) U.S. Cl.

CPC ..... *B05C 5/027* (2013.01); *B05B 7/2486* (2013.01); *B05B 7/2491* (2013.01); *B05C 5/001* (2013.01); *F17D 1/005* (2013.01); *B05B 7/0807* (2013.01)

(58) Field of Classification Search

CPC ..... B05C 5/001; B05C 5/0225; B05C 5/027; B05C 5/0275; B05C 5/0279; B05B 7/08; B05B 7/0807; B05B 7/2486; B05B 7/2489; B05B 7/2491; F17D 1/005

See application file for complete search history.

(56) References Cited

U.S. PATENT DOCUMENTS

| | | | |
|---|---|---|---|
| 3,006,559 | A | 10/1961 | Schmidt |
| 3,840,158 | A | 10/1974 | Baker et al. |
| 3,849,241 | A | 11/1974 | Butin et al. |

(Continued)

FOREIGN PATENT DOCUMENTS

| | | |
|---|---|---|
| DE | 8534594 U1 | 2/1986 |
| EP | 0282748 A1 | 9/1988 |

(Continued)

OTHER PUBLICATIONS

U.S. Patent and Trademark Office; Office Action in U.S. Appl. No. 12/569,240 dated Mar. 10, 2011; 10 pages.

(Continued)

*Primary Examiner* — Christopher Kim

(74) *Attorney, Agent, or Firm* — Baker & Hostetler LLP

(57) ABSTRACT

A dispenser for dispensing liquid material while attenuating the liquid material and controlling the pattern of the liquid material with process air has a manifold with a plurality of process air passages for providing the process air to one or more liquid dispensing modules. The pressure of process air to one or more of the modules may be separately controlled to be different from the pressure provided to other modules on the dispenser. Accordingly, the air pressure provided to each module can be optimized to accommodate a particular dispensing die.

13 Claims, 4 Drawing Sheets

(56) References Cited

U.S. PATENT DOCUMENTS

| | | | | |
|---|---|---|---|---|
| 4,073,850 | A | 2/1978 | Brackmann et al. | |
| 4,079,864 | A | 3/1978 | Cox | |
| 4,478,624 | A | 10/1984 | Battigelli et al. | |
| 4,488,665 | A | 12/1984 | Cocks et al. | |
| 4,526,733 | A | 7/1985 | Lau | |
| 4,687,137 | A | 8/1987 | Boger et al. | |
| 4,708,619 | A | 11/1987 | Balk | |
| 4,785,996 | A | 11/1988 | Ziecker et al. | |
| 4,815,660 | A * | 3/1989 | Boger | A61F 13/15577 118/302 |
| 4,891,249 | A | 1/1990 | McIntyre | |
| 4,893,109 | A | 1/1990 | Vrabel et al. | |
| 4,911,956 | A * | 3/1990 | Gabryszewski | B05B 7/0861 118/300 |
| 4,949,668 | A | 8/1990 | Heindel et al. | |
| 5,000,112 | A | 3/1991 | Rothen et al. | |
| 5,005,640 | A | 4/1991 | Lapinski et al. | |
| 5,102,484 | A | 4/1992 | Allen et al. | |
| 5,145,689 | A | 9/1992 | Allen et al. | |
| 5,172,833 | A | 12/1992 | Faulkner, III | |
| 5,194,115 | A | 3/1993 | Ramspeck et al. | |
| 5,236,641 | A | 8/1993 | Allen et al. | |
| 5,238,190 | A | 8/1993 | Herke | |
| 5,265,800 | A | 11/1993 | Ziecker et al. | |
| 5,269,670 | A | 12/1993 | Allen et al. | |
| 5,382,312 | A | 1/1995 | Raterman | |
| 5,407,101 | A | 4/1995 | Hubbard | |
| 5,418,009 | A | 5/1995 | Raterman et al. | |
| 5,421,941 | A | 6/1995 | Allen et al. | |
| 5,422,428 | A | 6/1995 | McGuire et al. | |
| 5,429,840 | A | 7/1995 | Raterman et al. | |
| 5,445,509 | A | 8/1995 | Allen et al. | |
| 5,445,674 | A | 8/1995 | Demars | |
| 5,458,291 | A | 10/1995 | Brusko et al. | |
| 5,533,675 | A | 7/1996 | Benecke et al. | |
| 5,540,804 | A | 7/1996 | Raterman | |
| 5,556,471 | A | 9/1996 | Boccagno et al. | |
| 5,605,720 | A | 2/1997 | Allen et al. | |
| 5,618,566 | A | 4/1997 | Allen et al. | |
| 5,620,139 | A | 4/1997 | Ziecker | |
| 5,636,790 | A | 6/1997 | Brusko et al. | |
| 5,679,379 | A | 10/1997 | Fabbricante et al. | |
| 5,683,752 | A | 11/1997 | Popp et al. | |
| 5,685,911 | A | 11/1997 | Raterman et al. | |
| 5,728,219 | A | 3/1998 | Allen et al. | |
| 5,740,963 | A | 4/1998 | Riney et al. | |
| 5,747,102 | A | 5/1998 | Smith et al. | |
| 5,862,986 | A | 1/1999 | Bolyard et al. | |
| 5,875,922 | A | 3/1999 | Chastine et al. | |
| 5,950,875 | A | 9/1999 | Lee et al. | |
| 6,089,413 | A | 7/2000 | Riney et al. | |
| 6,210,141 | B1 | 4/2001 | Allen | |
| 6,220,843 | B1 | 4/2001 | Allen | |
| 6,222,166 | B1 | 4/2001 | Lin et al. | |
| 6,286,551 | B1 | 9/2001 | Flatt et al. | |
| 6,296,463 | B1 | 10/2001 | Allen | |
| 6,422,428 | B1 * | 7/2002 | Allen | B05B 7/0807 222/255 |
| 6,457,608 | B1 | 10/2002 | Riney | |
| 6,499,629 | B1 | 12/2002 | Colangelo et al. | |
| 6,499,631 | B2 | 12/2002 | Zook | |
| 6,688,498 | B1 | 2/2004 | McGuffey | |
| 8,132,698 | B2 | 3/2012 | Raterman et al. | |
| 2002/0092865 | A1 | 7/2002 | Takagi et al. | |
| 2002/0139818 | A1 | 10/2002 | McGuffey | |
| 2003/0062384 | A1 | 4/2003 | McGuffey | |
| 2003/0168180 | A1 | 9/2003 | Saidman et al. | |
| 2005/0092775 | A1 | 5/2005 | Saidman et al. | |
| 2007/0215718 | A1 | 9/2007 | Saidman | |
| 2010/0018996 | A1 | 1/2010 | Saidman | |
| 2011/0006082 | A1 | 1/2011 | Saidman et al. | |

FOREIGN PATENT DOCUMENTS

| | | | |
|---|---|---|---|
| EP | 0819477 | A2 | 1/1998 |
| EP | 0820817 | A2 | 1/1998 |
| EP | 0936000 | A2 | 8/1999 |
| EP | 0997200 | A1 | 5/2000 |
| EP | 1331040 | A2 | 7/2003 |
| EP | 1591167 | A1 | 11/2005 |
| JP | 2003-245590 | A | 9/2003 |
| JP | 2005-238233 | A | 9/2005 |
| JP | 2005-313170 | A | 11/2005 |
| WO | 94/01221 | A1 | 1/1994 |
| WO | 99/46057 | A1 | 9/1999 |
| WO | 99/54055 | A1 | 10/1999 |

OTHER PUBLICATIONS

U.S. Patent and Trademark Office; Office Action in U.S. Appl. No. 12/159,008 dated Nov. 1, 2010; 6 pages.

U.S. Patent and Trademark Office; Final Office Action in U.S. Appl. No. 12/159,008 dated Jun. 14, 2011; 11 pages.

U.S. Patent and Trademark Office, Office Action in U.S. Appl. No. 11/748,765, dated Jun. 27, 2008.

U.S. Patent and Trademark Office, Office Action in U.S. Appl. No. 10/282,573, dated Oct. 9, 2007.

U.S. Patent and Trademark Office, Office Action in U.S. Appl. No. 10/282,573, dated May 20, 2005.

U.S. Patent and Trademark Office, Office Action in U.S. Appl. No. 10/282,573, dated Mar. 22, 2005.

U.S. Patent and Trademark Office, Final Office Action in U.S. Appl. No. 10/282,573, dated Jan. 29, 2007.

U.S. Patent and Trademark Office, Final Office Action in U.S. Appl. No. 10/282,573, dated Apr. 16, 2008.

US Patent and Trademark Office, Office Action issued in related U.S. Appl. No. 10/282,573 dated Dec. 11, 2008 (7 pages).

USPTO. Notice of Allowance issued in related U.S. Appl. No. 11/748,765.

Nordson Corporaton, Precision with Flexibility, The CF800M Metered Head, Trends, 1993.

Japanese Patent Office; Office Action in Japanese Patent Application No. 2008-549508 dated Aug. 28, 2012; 7 pages.

Japanese Patent Office; Office Action in Japanese Patent Application No. 2005-130653 dated Jun. 29, 2011; 2 pages.

ITW Dynatec, The Dynatec Advantage, Patented Vector Metering Applicator, Product Description, 2 pgs.

European Patent Office. European Search Report in European Application No. 10191188, dated Mar. 10, 2011.

European Patent Office. European Search Report in European Application No. 10191176, dated Mar. 10, 2011.

European Patent Office, Search Report in EP 05 00 7249, dated Jun. 22, 2005, 3 pgs.

European Patent Office, International Search Report and Written Opinion in PCT Application Serial No. PCT/US2006/049418, dated May 14, 2007.

European Patent Office, Extended Search Report dated Dec. 2, 2009 for related European Application No. 09164785.9.

European Patent Office, European Search Report issued in related European Patent Application No. 10177926.2 dated Nov. 8, 2010.

European Patent Office, European Search Report issued in related European application No. 10191510.6 dated Jan. 26, 2011.

European Patent Office, European Search Report in European Application No. 10191181, dated Mar. 10, 2011.

European Patent Office, European Search Report in European Application No. 10177926, dated Nov. 16, 2010.

European Patent Office, European Search Report in EP Application Serial No. 03000838, dated Apr. 27, 2007.

* cited by examiner

LIQUID DISPENSER HAVING INDIVIDUALIZED PROCESS AIR CONTROL

CROSS-REFERENCE

This application is a divisional of U.S. patent application Ser. No. 10/836,765 filed Apr. 30, 2004 (pending), the disclosure of which is expressly incorporated by reference herein in their entirety.

FIELD OF THE INVENTION

The present invention relates generally to liquid material dispensing systems, and more particularly to a liquid dispenser wherein process air to individual dispensing modules is separately controllable.

BACKGROUND OF THE INVENTION

Thermoplastic materials, such as hot melt adhesives, are used in a variety of applications including the manufacture of diapers, sanitary napkins, surgical drapes and various other products. The technology has evolved from the application of linear beads or fibers of material and other spray patterns, to air-assisted applications, such as spiral and melt-blown depositions of fibrous material.

Often, the applicators will include one or more dispensing modules for applying the intended deposition pattern. Many of these modules include valve components that permit the modules to operate in an on/off fashion. One example of this type of dispending module is disclosed in U.S. Pat. No. 6,089,413, assigned to the assignee of the present invention. The module includes valve structure which changes the module between on and off conditions relative to the dispensed material. In the off condition, the module enters a recirculating mode. In the recirculating mode, the module redirects the pressurized material from the liquid material inlet of the module to a recirculation outlet which, for example, leads back into a supply manifold and prevents the material from stagnating. Other modules and valves have also been used to provide selective metering and/or on/off control of material deposition.

Various dies or applicators have also been developed to provide the user with flexibility in dispensing material from a series of modules. For example, many dispensers are flexible with respect to the number of dispensing modules which can be mounted to the applicator for dispensing liquid material to a substrate. Additional flexibility may be provided by using different die tips or nozzles on the modules to permit a variety of deposition patterns across the applicator to be applied to the substrate. The most common types of air-assisted dies or nozzles include melt-blowing dies, spiral nozzles, and spray nozzles. Pressurized air is used to either draw down or attenuate the fiber diameter in a melt-blowing application, or to produce a particular deposition pattern. When using hot melt adhesives or other heated thermoplastic materials, the process air is typically heated so that it does not substantially cool the thermoplastic material prior to deposition on the substrate.

An exemplary applicator which permits additional flexibility by allowing users to tailor the applicator to specific needs is shown and described in U.S. Pat. No. 6,422,428, commonly assigned to the assignee of the present invention and hereby incorporated by reference in its entirety. This applicator comprises multiple manifold segments which may be selectively added or removed from the applicator to adjust the width of the liquid material dispensed from respective liquid dispensing modules secured to the individual manifolds segments.

In certain applications, it may be desired to use dispensing modules of different types to obtain varied patterns or forms of dispensed liquid material applied to a substrate. Spray applications may require different operating pressures for process air used to attenuate and control the pattern of dispensed liquid material when different modules are used on the same dispenser. In conventional applications however, the liquid dispenser is supplied by a single source of pressurized air and the manifold is not capable of receiving inputs from separately controlled pressure sources. Accordingly, when different types of liquid dispensing modules are used on a single dispenser, the process air pressure for the dispenser must be selected to work with all of the dispensing modules, therefore individual modules may not be receiving process air at a pressure that optimizes performance.

A need therefore exists for a liquid dispenser capable of providing selectively controlled pressurized air to individual modules used to dispense liquid material.

SUMMARY OF THE INVENTION

The present invention provides a liquid material dispenser that utilizes pressurized process air to attenuate and control the pattern of liquid material dispensed therefrom. The dispenser includes a manifold that is adapted to receive pressurized air and which has a plurality of process air passages for supplying the pressurized air to respective liquid dispensing modules coupled to the manifold. The dispenser further includes a control operative to adjust the pressure of process air supplied to one of the modules independently with respect the pressure of process air supplied to another one of the modules.

In one embodiment, the control for adjusting the pressure of process air is a pressure regulator communicating with the process air passage of the module. In another embodiment, the control comprises a plurality of independent sources of pressurized air coupled to the modules. The manifold may also include an air distribution passage that interconnects several of the process air passages, whereby respectively associated modules may be provided with process air at a common pressure.

In another embodiment, the manifold comprises a plurality of manifold segments that are coupled together in a side-by-side arrangement. Each manifold segment is formed with process air passages whereby the pressure of process air provided through the segment to an associated dispensing module may be separately controlled as described above. Different dispensing dies can be coupled to the respective modules and the pressure provided to the modules controlled such that operation of the die is optimized.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
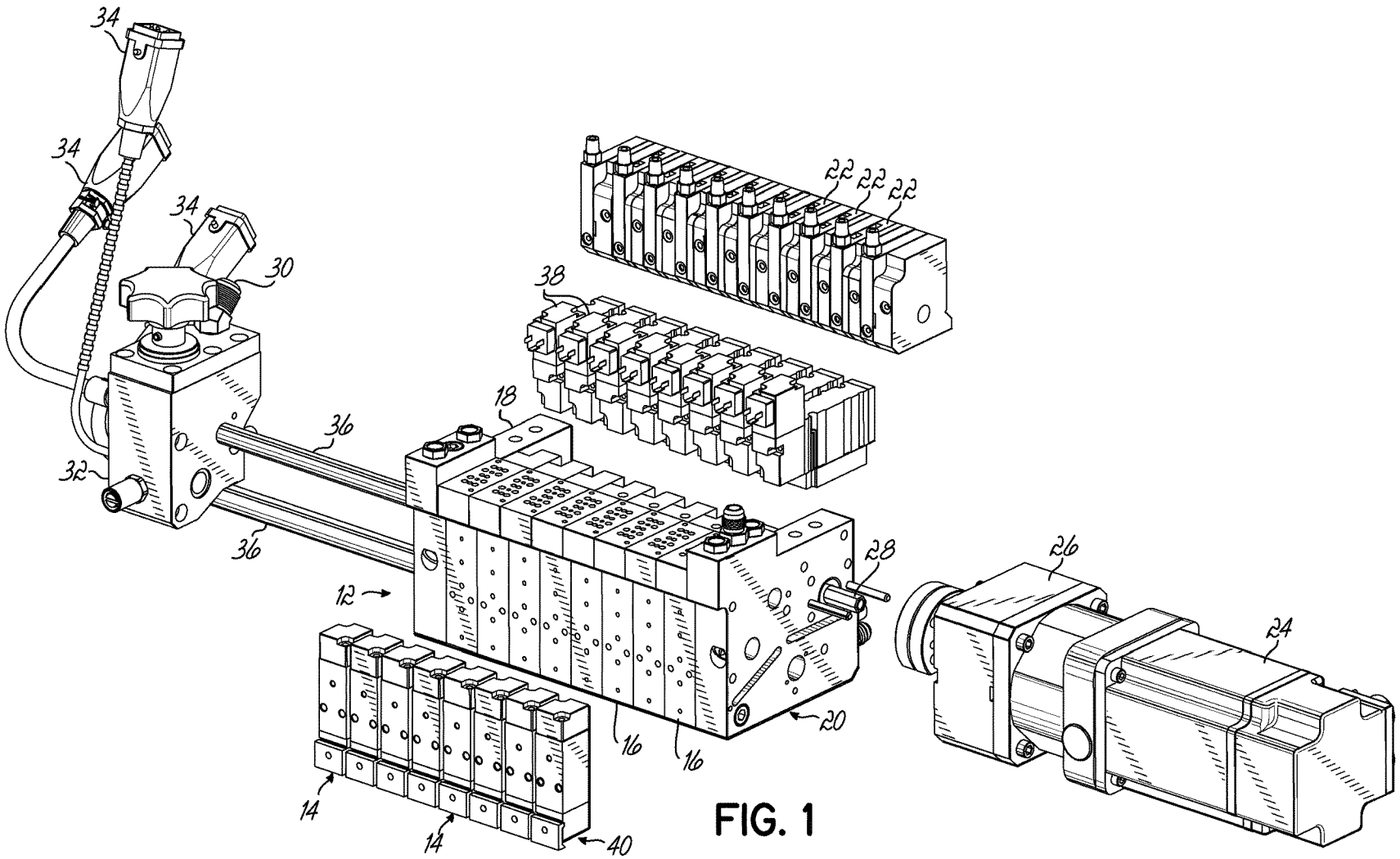
FIG. 1 is an exploded perspective view of an exemplary liquid dispensing system according to the present invention.
Figure 2:
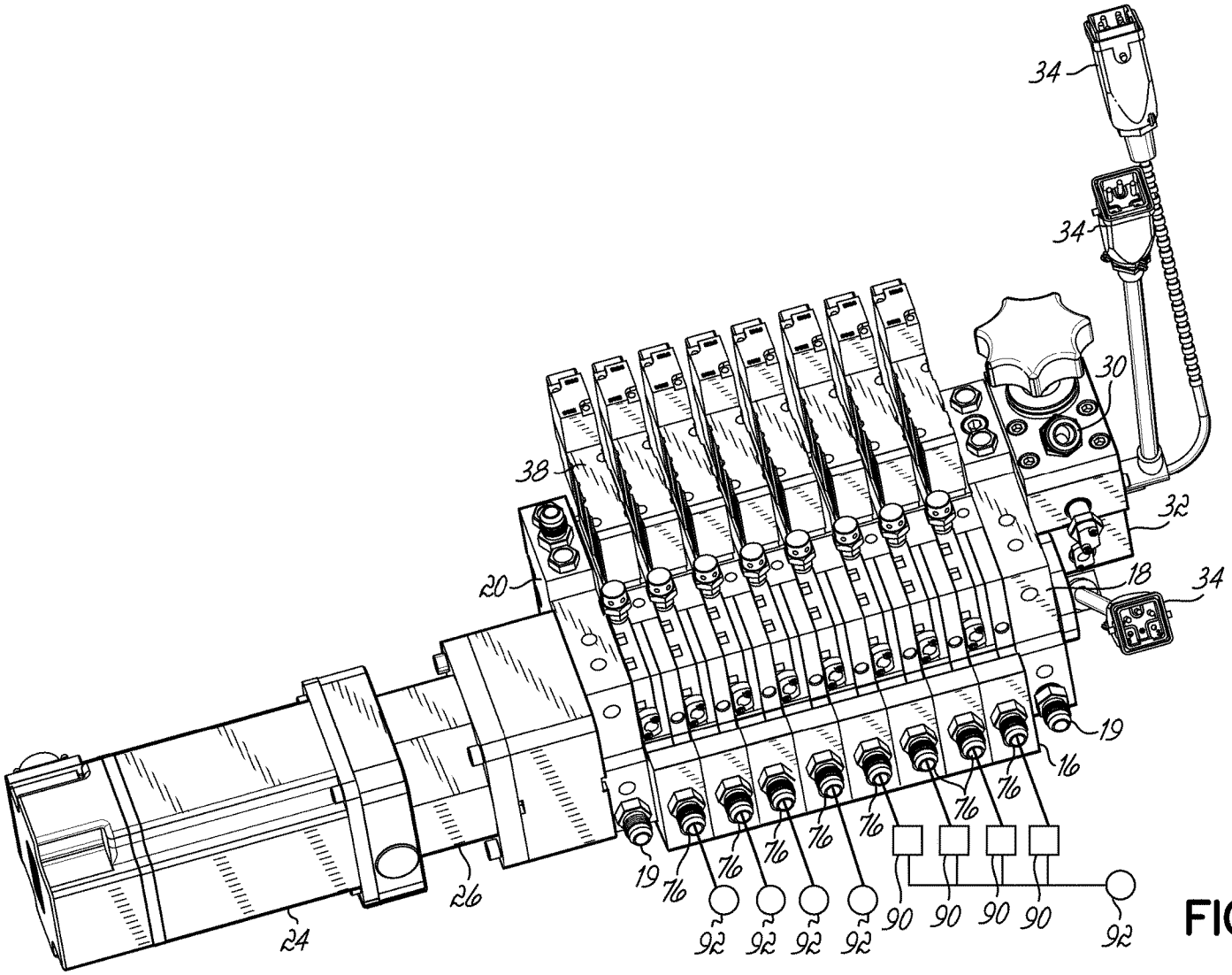
FIG. 2 is a perspective view depicting the rear side of the assembled liquid dispenser of FIG. 1.

FIGS. 1 and 2 depict an exemplary metered liquid dispensing system 10 of the present invention, including a liquid dispensing applicator 12 having a plurality of dispensing modules 14. The applicator 12 is configured to individually meter the flow of liquid material through each module 14, whereby individually metered streams of liquid material may be dispensed to a substrate material. One such applicator particularly suited to this type of operation is the Universal Slice™ Applicator, available from Nordson Corporation of Westlake, Ohio and disclosed in U.S. Pat. No. 6,422,428, assigned to the assignee of the present invention, herein incorporated by reference in its entirety.

With continued reference to FIGS. 1 and 2, the applicator 12 includes several manifold segments 16 that are coupled together. Each manifold segment 16 is configured to supply liquid material to an individual module 14 that is coupled to the manifold segment 16. The manifold segments 16 are sandwiched between first and second endplates 18, 20 and secured by fasteners (not shown). Endplates 18, 20 are provided with fittings 19 for connecting the applicator 12 to appropriate air sources. The applicator 12 further includes several positive displacement pumps 22 such as gear pumps. Each gear pump 22 is coupled to a respective manifold segment 16 and has liquid ports which mate with respective ports on an associated manifold segment 16. The gear pumps 22 meter the liquid material through respective manifold segments 16 and modules 14 to be dispensed from nozzles or die tips 40 coupled to the modules 14, as more fully described in U.S. Pat. No. 6,422,428.

In the exemplary embodiment shown, a motor 24 and gear box 26 are coupled to a drive shaft 28 which extends through each of the gear pumps 22 to thereby drive the gear pumps 22. Liquid material is provided to the applicator 12 through a liquid material input 30 located on a filter block 32 and the liquid material is filtered in the filter block 32 prior to being supplied to the manifold segments 16. The applicator 12 further includes electric cord sets 34 and heater rods 36 for heating the manifold segments 16. The applicator 12 also includes air control valves 38 which are couplable to the manifold segments 16 to provide pressurized control air to the modules 14. Process air is also provided to the modules 14 and may be dispensed by the modules 14 to attenuate and control the pattern of liquid material dispensed from the applicator 12. The applicator 12 of the present invention further includes nozzles or die tips 40 configured to receive liquid material inputs from the modules 14 and to dispense the liquid material in an arrangement of closely spaced filaments or ribbons from a plurality of liquid discharge outlets. Advantageously, each filament or ribbon dispensed from the die tip 40 is associated with an individual flow-metering source, such as the gear pumps 22 of the exemplary embodiment, whereby the dispense rate of each liquid stream is independent the other liquid streams.

The exemplary liquid dispenser of FIGS. 1-2 is similar to the liquid dispenser shown and described in U.S. Pat. No. 6,422,428, with the exception that the individual manifold segments are configured to be independently controlled to vary the pressure of process air supplied to respective modules associated with each manifold segment. Operation of the liquid dispenser is thus similar in most respects to the dispenser disclosed in U.S. Pat. No. 6,422,428 and only the differences which are the subject of the present invention will be described in detail.

Figure 3:
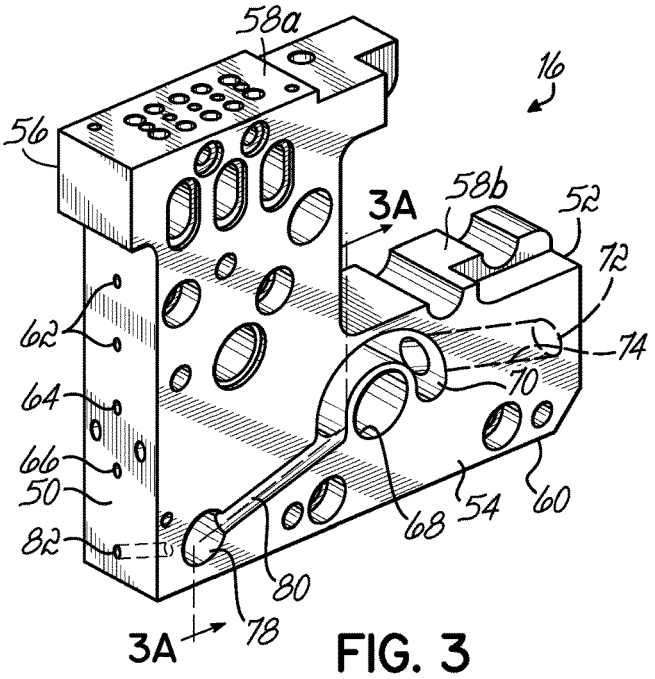
FIG. 3 is a perspective view of an individual manifold segment of the liquid dispenser of FIG. 1.
Figure 3A:
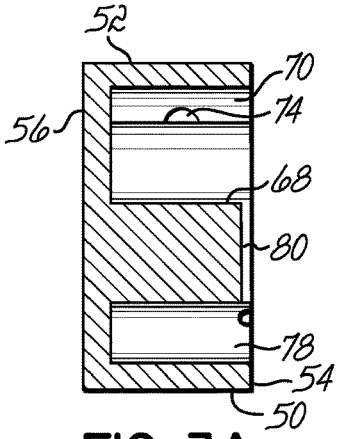
FIG. 3A is a cross-sectional view of the manifold segment of FIG. 3, taken along line 3A-3A.

Referring now to FIGS. 3 and 3A, an exemplary manifold segment 16, according to the present invention is shown having oppositely disposed front and rear faces 50, 52, oppositely disposed first and second side faces 54, 56, upper faces 58*a*, 58*b* and an oppositely disposed lower face 60. The manifold segment 16 is similar to the manifold segment shown and described in U.S. Pat. No. 6,422,428, but has been modified such that the manifold segment 16 can receive pressurized process air and supply it to an individual dispensing module 14. Accordingly, the manifold segment 16 includes control air outlets 62, a recirculated liquid material outlet 64 and a dispensed liquid material outlet 66 formed through front face 50, as described in U.S. Pat. No. 6,422,428. The manifold segment 16 further includes a heater bore 68 extending through the manifold segment 16 between the first and second side faces 54, 56 and positioned to mate with corresponding bores formed through adjacent manifold segments 16 to receive a heater rod 36 therethrough for heating incoming process air, as disclosed in U.S. Pat. No. 6,422,428. Instead of having a plurality of through-bores formed in a circular pattern around the heater bore 68, however, the manifold segment 16 has an arcuate air slot 70 formed into the first side face 54 and extending toward the second face 56. The air slot 70 does not extend completely through the thickness of the manifold segment 16 but is closed on the second side face 56.

With continued reference to FIGS. 3 and 3A, a process air inlet port 72 is formed through the rear face 52 of the manifold segment 16, approximately at the location disclosed in U.S. Pat. No. 6,422,428 for the receipt of a temperature probe. The process air inlet port 72 is in fluid communication with the air slot 70 via an air supply passage 74 extending therebetween, whereby process air from a pressurized air source may be supplied to the manifold segment 16, for example, by coupling an appropriate fitting 76 (see FIG. 2) and supply line (not shown) to the process air inlet port 72. The manifold segment 16 further includes an air distribution passage 78 extending from the first side face 54 of the manifold segment 16 in a direction toward the second side face 56, but not completely through the thickness of the manifold segment 16. The air distribution passage 78 is in the same location as the air distribution passage disclosed in U.S. Pat. No. 6,422,428, and is similar to that air distribution passage with the exception that the passage 78 does not extend completely through the manifold 16 segment.

An air supply channel 80 is formed between the air slot 70 and the air distribution passage 78, on the first side face 54 of the manifold segment 16 and a process air outlet passage 82 is formed through the front face 50 of the manifold segment 16 to communicate with the air distribution passage 78. Process air supplied to the manifold segment 16 through the inlet port 72 flows through the inlet passage 74, through the air slot 70 and air supply channel 80 to the distribution passage 78 and outlet passage 82 to appropriate air passages formed in the dispensing module 14, as disclosed in U.S. Pat. No. 6,422,428. Advantageously, when several manifold segments 16 are assembled in a side-by-side arrangement to form the applicator 12 of the liquid dispenser 10, the first side faces 54 of the individual manifold segments 16 sealingly engage corresponding second side faces 56 of adjacent manifold segments 16 to thereby seal off the process air passages formed in each manifold segment 16. In this manner, process air may be independently supplied through each manifold segment 16 to an associated liquid dispensing module 14.

Referring now to FIGS. 2, 3 and 3A, when applications require different pressures for selected modules 14 on the liquid dispenser 10, individual supply lines connected to the process air inlet ports 72 of associated manifold segments 16 may be coupled to pressure regulators 90 to control the pressure of air provided to the manifold segment from a common pressurized air source 92, as depicted schematically in FIG. 2. Alternatively, it will be recognized that each manifold segment 16 could be coupled to respective independent sources 90 of pressurized air, also depicted in FIG. 2.

Figure 4:
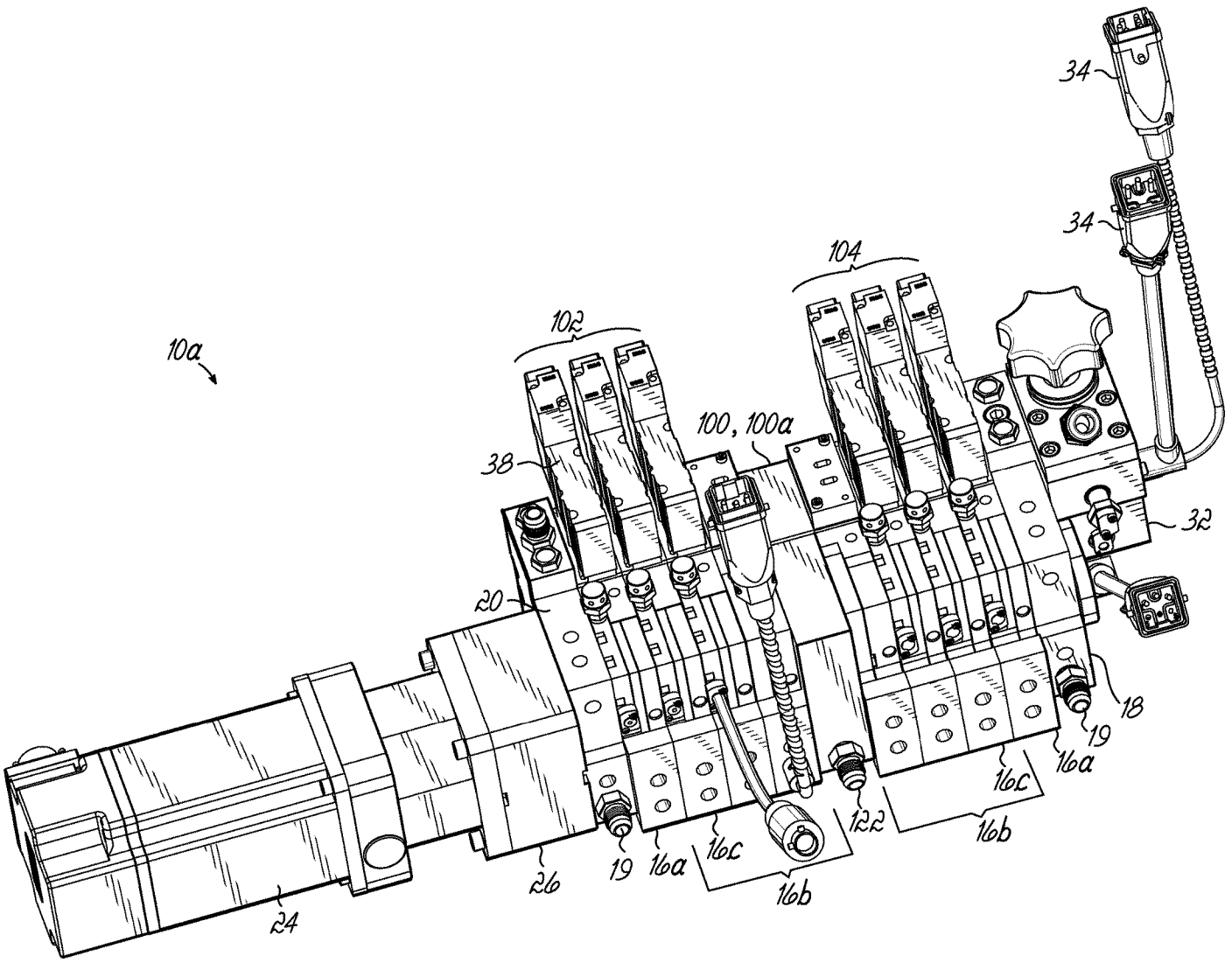
FIG. 4 is a perspective view of another embodiment of a liquid dispenser according to the present invention.

Referring now to FIG. 4, there is shown another embodiment of a liquid dispenser according to the present invention which is useful for providing pressurized air to a first group of modules on the dispenser at one pressure, and pressurized air at a different pressure to other modules of the dispenser. While it will be recognized that such an arrangement could be accomplished by using separate supply lines to connect individual manifold segments 16 of the dispenser 10 shown and described in FIGS. 1-3 to separate pressure sources, the embodiment shown in FIG. 4 utilizes manifold segments and end plates as disclosed in U.S. Pat. No. 6,422,428 together with the manifold segments 16 shown in FIGS. 3 and 3A to permit a single supply line to provide process air to several dispensing modules 14.

In the embodiment shown, the liquid dispenser 10*a* includes an intermediate plate 100 disposed between separate banks 102, 104 of dispensing modules 14. If the two banks 102, 104 of modules 14 are to receive process air at different pressures, the manifold segments in each bank 102, 104 may be of the design set forth in U.S. Pat. No. 6,422,428 and the intermediate plate 100 will have one side formed with slots and apertures corresponding to an end plate as disclosed therein. The other side of the intermediate plate 100 will have slots and apertures formed in a similar manner, but arranged to cooperate with the manifold segments adjacent that side of the intermediate plate, as shown in FIGS. 5 and 5A and described more fully below.

Figure 5:
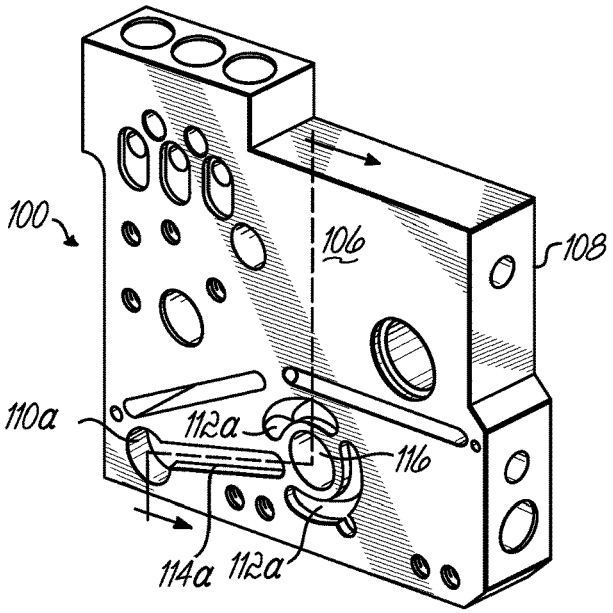
FIG. 5 is a perspective view of an intermediate plate used with the liquid dispenser of FIG. 4.
Figure 5A:
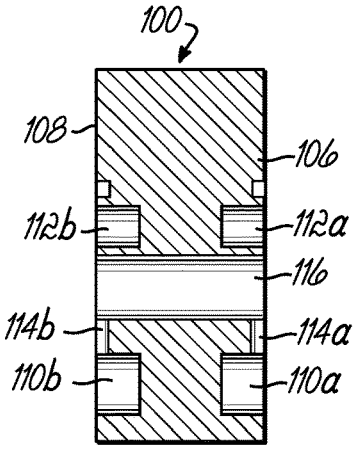
FIG. 5A is a cross-sectional view of the intermediate plate of FIG. 5, taken along line 5A-5A.

FIGS. 5 and 5A depict an intermediate plate 100 for the dispenser 10*a* of FIG. 4 when process air is to be distributed as described above. Respective first and second sides 106, 108 of the intermediate plate 100 are configured to accommodate the abutting manifold segments in the same manner as the end plates of U.S. Pat. No. 6,422,428. Specifically, the air supply channels 110*a*, 110*b*, arcuate slots 112*a*, 112*b* and air distribution passages 114*a*, 114*b* formed to the first and second sides 106, 108 of intermediate plate 100 do not extend through the intermediate plate 100. Rather, these features cooperate with the respective adjacent manifold segments to direct air flowing through the bores of those segments into the respective air distribution passages formed by the connected manifold segments, as described in U.S. Pat. No. 6,422,428. The heater bore 116, however, does extend through the intermediate plate 100, to accommodate the heater rod 36 that heats the process air.

The dispenser 10*a* of FIG. 4 may alternatively be configured to provide process air from each end plate 18, 20 to one or more of the manifold segments 16*a* adjacent the respective end plates 18, 20, while the intermediate plate 100 provides process air to one or more of the inboard manifold segments 16*b* at a different pressure. For example, it may be desired to provide process air at a first pressure to only one manifold segment 16*a* adjacent each of the end plates 18, 20, and to provide process air at a different pressure to the inboard manifold segments 16*b* of each bank 102, 104 at a different pressure. This type of arrangement could be used, for example, to dispense liquid material, such as hot melt adhesive, in a different pattern or dispense rate on the outermost edge of a substrate, such as a diaper, using a different type of dispensing die, as described above. A manifold segment and intermediate plate arrangement for accomplishing this is described below with reference to FIGS. 5 and 5B.

To dispense liquid material as described above, the end plates 18, 20 will be of the same configuration disclosed in U.S. Pat. No. 6,422,428 and the adjacent manifold segments. 16*a* will be similar to the configuration discussed above with respect to FIGS. 3 and 3A, with the exception that the air inlet port 72 is not required for this configuration since process air can be supplied through fittings 19 on end plates 18 and 20. Accordingly, the air inlet port may be plugged or omitted. It will be recognized that the manifold segment 16*a* adjacent the second end plate 20 will be formed as a mirror image of the manifold segment 16 depicted in FIGS. 3 and 3A, such that the slots and apertures are formed on the second side 56, instead of first side 54, to mate with the second end plate 20.

Figure 5B:
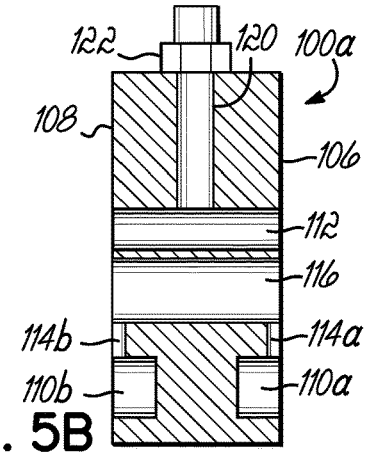
FIG. 5B is a cross-sectional view similar to FIG. 5A, depicting another embodiment of the intermediate plate of FIG. 5.

The process air modules 14 furthest from end plates 18, 20 are supplied by an intermediate plate 100*a*. Accordingly, the intermediate plate 100*a* has a configuration of air apertures and air slots similar to those shown in FIG. 5A, but the apertures and slots extend completely through the intermediate plate 100*a*, as shown in FIG. 5B. The intermediate plate 100*a* further includes an air inlet port 120 formed through the rear face and in fluid communication with the arcuate air slots 112. Process air is provided to the intermediate plate 100*a* through a fitting coupled 122 to the air inlet port 120 and connected to a supply of pressurized air. The process air flows through the inlet port 120, through the lower arcuate slot 112 and into the bores on adjacent manifold segments.

The inboard manifold segments 16*b* immediately adjacent the intermediate plate 100*a* are configured as disclosed in U.S. Pat. No. 6,422,428. The outermost or end manifold segments 16*c* of the inboard modules 16*b* is configured as shown and described above with respect to FIGS. 3 and 3A, with the exception that the air inlet port 72 is not needed, and therefore may be plugged or omitted. Process air is provided to the manifold segments 16 from the lower arcuate slot 112 of the intermediate plate 100*a* and travels through the bores of the first manifold segments 16*b*, as described in U.S. Pat. No. 6,422,428, through the arcuate slot 70 of the end manifold segment 16*c*, through the air supply channel 80 and into the air distribution passage 78 for distribution to the modules 14.

Advantageously, the various liquid dispenser embodiments described above can provide process air to dispensing modules 14 coupled to the dispensers 10, 10*a* such that the pressure of process air to individual modules or groups of modules can be controlled separately from other modules coupled to the dispensers. Different pressures can be provided by connecting the appropriate manifold segments 16 to different sources of pressurized air, or by regulating the air from a single source, as described above.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A liquid adhesive material dispenser, comprising:

a plurality of heated manifold segments coupled in a side-by-side arrangement, said plurality of heated manifold segments including a first group comprising more than one heated manifold segment and a second group comprising at least one heated manifold segment;

each of said heated manifold segments includes a first passage for transferring liquid adhesive material and a second passage for transferring heated process air;

said first passages of all of said heated manifold segments are coupled in fluid communication;

said second passages of said first group of said heated manifold segments are coupled in fluid communication with one another and are not in fluid communication with said heated manifold segments of said second group;

said second passages of said second group of said heated manifold segments are coupled in fluid communication with one another and are not in fluid communication with said heated manifold segments of said first group;

a plurality of liquid adhesive dispensing modules positioned in a side-by-side arrangement across a width of said plurality of heated manifold segments, each of said liquid adhesive dispensing modules having a liquid adhesive discharge outlet coupled in fluid communication with said first passage of a respective one of said heated manifold segments, and each of said liquid adhesive dispensing modules dispenses the liquid adhesive as a filament, and each of said liquid adhesive dispensing modules having a heated process air discharge outlet coupled in fluid communication with said second passage of a respective one of said heated manifold segments and arranged to direct heated process air to impinge upon the liquid adhesive filament as the liquid adhesive filament is dispensed from said liquid adhesive discharge outlet and thereby attenuate and control the liquid adhesive filament; and a control operative to independently adjust, as a group, the pressure of the heated process air dispensed by all of said liquid adhesive dispensing modules coupled to said first group of heated manifold segments relative to the pressure of the heated process air dispensed by all of said liquid adhesive dispensing modules coupled to said second group of heated manifold segments, so that the pressure of the heated process air dispensed by said liquid adhesive dispensing modules coupled with said first group of heated manifold segments is different than the pressure of the heated process air dispensed by said liquid adhesive dispensing modules coupled with said second group of heated manifold segments.

2. The dispenser of claim 1, further comprising:

a plate disposed between said first group of heated manifold segments and said second group of heated manifold segments, said plate preventing the transfer of heated process air between said first group of heated manifold segments and said second group of heated manifold segments.

3. The dispenser of claim 1, comprising at least two second manifold segments, with at least one second manifold segment located at each of the respectively opposite outboard ends of said centrally-located first manifold segments.

4. The dispenser of claim 3, further comprising a first plate disposed between a first group of said plurality of centrally-located first manifold segments and a second group of said plurality of centrally-located first manifold segments, said first plate supplying process air to said plurality of centrally-located first manifold segments.

5. The dispenser of claim 4, further comprising a second plate operatively coupled to said at least one second manifold segment, said second plate supplying process air to said at least one second manifold segment.

6. A manifold segment for a liquid dispensing system, the manifold segment comprising:

a manifold segment body having oppositely disposed first and second faces and oppositely disposed front and rear faces, wherein each of the first and second faces extends from the front face to the rear face and is adapted for coupling the manifold segment to adjacent manifold segments in a side-by-side arrangement;

a liquid passage for transferring liquid material to a dispensing module when the module is coupled to the manifold segment, wherein the liquid passage is in fluid communication with a liquid channel of each of the adjacent manifold segments;

a process air inlet port defined by the rear face;

a process air outlet passage defined by the front face for supplying process air to the dispensing module when the module is coupled to the manifold segment; and a channel formed on said first face and spaced in an entirety from the second face, wherein the channel provides fluid communication between said process air inlet port and said process air outlet passage.

7. A liquid material dispenser, comprising:

a plurality of manifold segments, each of said manifold segments, comprising:

a manifold segment body having oppositely disposed first and second faces adapted for coupling the manifold segment to adjacent manifold segments in a side-by-side arrangement, a liquid passage for transferring liquid material to a liquid dispensing module when the module is coupled to the manifold segment, a process air inlet port, a process air outlet passage for supplying process air to the liquid dispensing module when the module is coupled to the manifold segment, and a channel formed on said first face and providing fluid communication between said process air inlet port and said process air outlet passage;

at least two of said plurality of manifold segments coupled in a side-by-side arrangement such that said channel of one of said manifold segments is sealed off by abutment with an adjacent manifold segment;

a plurality of liquid dispensing modules positioned in a side-by-side arrangement across a width of said plurality of manifold segments, each of said liquid dispensing modules having a liquid discharge outlet coupled in fluid communication with said liquid passage of a respective one of said manifold segments, and each of said liquid dispensing modules having an air discharge outlet coupled in fluid communication with said process air outlet passage of a respective one of said manifold segments, each said process air outlet passage arranged to direct process air to impinge upon the liquid material as the liquid material is dispensed from said liquid discharge outlet and thereby attenuate and control the liquid material as the liquid material is dispensed from said liquid discharge outlet; and a control operative to independently adjust the pressure of process air dispensed by at least one of said plurality of liquid dispensing modules relative to the pressure of process air dispensed by at least one other one of said plurality liquid dispensing modules.

8. The dispenser of claim 7, further comprising:

a plate disposed between a first group of said plurality of manifold segments and at least one second manifold segment, said plate preventing the transfer of process air between said first group of said manifold segments and said at least one second manifold segment.

9. A liquid material dispenser, comprising:

a manifold comprising a plurality of manifold segments coupled together in side-by-side relation, each manifold segment comprising:

a manifold segment body having oppositely disposed first and second faces and oppositely disposed front and rear faces, wherein each of the first and second faces extends from the front face to the rear face and is adapted for coupling the manifold segment to adjacent manifold segments;

a liquid passage for transferring liquid material;

a process air inlet port defined by the rear face;

a process air outlet passage defined by the front face; and a channel formed on said first face and spaced in an entirety from the second face, wherein the channel and a surface of an adjacent manifold segment define an air passageway that provides fluid communication between said process air inlet port and said process air outlet passage;

a plurality of liquid dispensing modules operatively coupled to said manifold, each of said liquid dispensing modules having at least one air discharge outlet in communication with said process air outlet passage of one said manifold segments and a liquid adhesive discharge outlet in fluid communication with said liquid passage of one of said manifold segments; and a control operative to adjust the pressure of the process air supplied to one of said liquid dispensing modules independently with respect to the process air supplied to another one of said liquid dispensing modules.

10. The dispenser of claim 9, further comprising a plurality of independent liquid flow metering devices, each liquid flow metering device operatively coupled with one of said liquid dispensing modules to independently control at least one of the pressure or the flow rate of liquid material discharged therefrom.

11. The dispenser of claim 9, wherein said control comprises a plurality of pressure regulators.

12. The dispenser of claim 9, wherein said control comprises independent sources of pressurized air.

13. The dispenser of claim 9, wherein each of said plurality of manifold segments defines a heater passage, wherein each heater passage is in communication with each other and is configured to receive a heater rod.

* * * * *